US008941495B2

(12) United States Patent
Wiese et al.

(10) Patent No.: US 8,941,495 B2
(45) Date of Patent: Jan. 27, 2015

(54) WIRELESS SHELF PUSHER ACTIVITY DETECTION SYSTEM AND ASSOCIATED METHODS

(75) Inventors: Brian Wiese, Lyndhurst, OH (US); David Christianson, Charlotte, NC (US); Mark Shafer, Charlotte, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 271 days.

(21) Appl. No.: 13/493,627

(22) Filed: Jun. 11, 2012

(65) Prior Publication Data

US 2013/0002422 A1 Jan. 3, 2013

Related U.S. Application Data

(60) Provisional application No. 61/495,658, filed on Jun. 10, 2011.

(51) Int. Cl.

| | |
|---|---|
| ***G08B 13/14*** | (2006.01) |
| ***G08B 13/08*** | (2006.01) |
| ***G08B 13/16*** | (2006.01) |

(52) U.S. Cl.

CPC ..... *G08B 13/08* (2013.01); *G08B 13/1654* (2013.01)

USPC ..... 340/568.8; 340/539.1; 211/59.2; 221/4; 700/231

(58) Field of Classification Search

CPC ..... G08B 13/1481; G08B 13/149; G08B 13/1436; G08B 13/14; G06Q 10/087; G06Q 10/0875; G06Q 20/203

USPC ..... 340/568.8, 539.1, 592; 221/4; 705/28, 705/22; 211/59.2; 700/231

See application file for complete search history.

(56) References Cited

U.S. PATENT DOCUMENTS

| | | | |
|---|---|---|---|
| 4,007,853 | A | 2/1977 | Bahneman |
| 4,830,201 | A | 5/1989 | Breslow |
| 4,887,737 | A | 12/1989 | Adenau |
| 5,263,596 | A | 11/1993 | Williams |
| 5,730,320 | A | 3/1998 | David |
| 5,927,540 | A | 7/1999 | Godlewski |
| 6,041,720 | A | 3/2000 | Hardy |
| 7,150,365 | B2 | 12/2006 | Hardy et al. |

(Continued)

FOREIGN PATENT DOCUMENTS

| | | |
|---|---|---|
| EP | 1579789 | 9/2005 |
| WO | 2009021014 | 2/2009 |

*Primary Examiner* — Steven Lim

*Assistant Examiner* — Hongmin Fan

(74) *Attorney, Agent, or Firm* — Nathaniel T. Quirk; Richard A. Howe, II

(57) ABSTRACT

According to some example embodiments, systems, apparatus, methods, computer readable media, and computer program products are provided for implementing a wireless shelf pusher activity detection system. One example apparatus is a monitoring device for monitoring theft or sales activity associated with a product pusher device. The monitoring device may include a sensor configured to detect movement of a pusher member of the product pusher device, a wireless communications interface, and a processor. The processor may be configured to receive at least one sensor signal from the sensor indicating movement of the pusher member, determine a product movement activity type based on characteristics of the at least one sensor signal, and generate, for transmission via the wireless communications interface, a pusher activity message indicating the product movement activity type.

29 Claims, 6 Drawing Sheets

(56) References Cited

U.S. PATENT DOCUMENTS

| | | | | |
|---|---|---|---|---|
| 7,299,934 | B2 | 11/2007 | Hardy et al. | |
| 7,469,791 | B2 | 12/2008 | Phoy | |
| 7,497,341 | B2 | 3/2009 | Hardy et al. | |
| 7,641,072 | B1 | 1/2010 | Vlastakis et al. | |
| 7,661,545 | B2 | 2/2010 | Hardy et al. | |
| 7,669,722 | B2 | 3/2010 | Hardy et al. | |
| 7,792,711 | B2 | 9/2010 | Swafford, Jr. | |
| 8,047,385 | B2 | 11/2011 | Hardy | |
| 8,146,753 | B2 | 4/2012 | Yuyama | |
| 8,235,222 | B2 | 8/2012 | Hardy | |
| 8,260,456 | B2 | 9/2012 | Siegel | |
| 2001/0000019 | A1 | 3/2001 | Bowers | |
| 2005/0040123 | A1 | 2/2005 | Ali | |
| 2005/0279722 | A1* | 12/2005 | Ali | 211/59.3 |
| 2009/0212065 | A1 | 8/2009 | Templer et al. | |
| 2009/0242582 | A1 | 10/2009 | Vlastakis | |
| 2009/0319399 | A1 | 12/2009 | Resta et al. | |
| 2011/0015781 | A1 | 1/2011 | Vardaro | |
| 2011/0055103 | A1 | 3/2011 | Swafford, Jr. et al. | |
| 2011/0068921 | A1* | 3/2011 | Shafer | 340/571 |
| 2011/0087369 | A1 | 4/2011 | Bauer | |
| 2011/0215060 | A1 | 9/2011 | Niederhuefner | |
| 2011/0218889 | A1* | 9/2011 | Westberg et al. | 705/28 |
| 2011/0282768 | A1* | 11/2011 | Swafford et al. | 705/28 |
| 2011/0304316 | A1 | 12/2011 | Hachmann et al. | |
| 2012/0091162 | A1 | 4/2012 | Overhultz et al. | |
| 2012/0310570 | A1 | 12/2012 | Pyne et al. | |

* cited by examiner

WIRELESS SHELF PUSHER ACTIVITY DETECTION SYSTEM AND ASSOCIATED METHODS

CROSS REFERENCE TO RELATED APPLICATIONS

This application claims priority from U.S. Provisional Application 61/495,658, filed on Jun. 10, 2011 and titled "WIRELESS SHELF PUSHER ACTIVITY DETECTION SYSTEM AND ASSOCIATED METHODS," the content of which is incorporated herein by reference in its entirety.

TECHNOLOGICAL FIELD

Various embodiments of the present invention relate generally to theft deterrent and inventory technology and, more particularly, relate to a wireless shelf pusher activity detection system and associated methods.

BACKGROUND

Retailers and business owners can suffer substantial financial losses as a result of retail theft. It is becoming increasingly common for shoplifters and thieves to implement organized and coordinated plans involving multiple individuals to steal large amounts of high priced goods from retail and other establishments. To protect against such losses, store owners have installed various systems that operate to deter theft through the use of alarms and other deterrent mechanisms. However, as thieves become more sophisticated, theft deterrent systems may be circumvented by new techniques and equipment used by would-be thieves. As such, the technology used for theft deterrence must continue to evolve to meet and exceed the continually evolving sophistication of theft techniques, and in particular, organized theft techniques.

BRIEF SUMMARY

Example embodiments of the present invention are therefore provided that perform activity detection with respect to product pusher devices and wireless reporting of the activity. In this regard, one example embodiment is a method for monitoring theft or sales activity associated with a product pusher device. The example method may include detecting, via a sensor, movement of a pusher member of the product pusher device, receiving at least one sensor signal from the sensor indicating movement of the pusher member, and determining a product movement activity type based on characteristics of the at least one sensor signal. The product movement activity type may be selected from a group of product movement activity types that includes removal of a product from the product pusher device. The example method may also include generating a pusher activity message indicating the product movement activity type, and transmitting the pusher activity message via a wireless communications interface.

Another example embodiment is an apparatus that is a monitoring device for monitoring theft or sales activity associated with a product pusher device. The monitoring device may include a sensor configured to detect movement of a pusher member of the product pusher device, a wireless communications interface, and a processor. The processor may be configured to receive at least one sensor signal from the sensor indicating movement of the pusher member, determine a product movement activity type based on characteristics of the at least one sensor signal, and generate, for transmission via the wireless communications interface, a pusher activity message indicating the product movement activity type.

Yet another example embodiment is a computer readable medium, such as a non-transitory computer readable memory. The computer readable medium may include, or for example store, computer program code configured to cause an apparatus to perform particular functionality. In this regard, the computer program code may cause the apparatus to perform receiving at least one sensor signal from a sensor indicating movement of a pusher member of a product pusher device, determining a product movement activity type based on characteristics of the at least one sensor signal, and generating a pusher activity message indicating the product movement activity type for transmission via a wireless communications interface.

Another example embodiment is an apparatus. The example apparatus may include means for receiving at least one sensor signal from a sensor indicating movement of a pusher member of a product pusher device, means for determining a product movement activity type based on characteristics of the at least one sensor signal, and means for generating a pusher activity message indicating the product movement activity type for transmission via a wireless communications interface.

BRIEF DESCRIPTION OF THE SEVERAL VIEWS OF THE DRAWING(S)

Having thus described the various example embodiments of the invention in general terms, reference will now be made to the accompanying drawings, which are not necessarily drawn to scale, and wherein:

DETAILED DESCRIPTION

Figure 1:
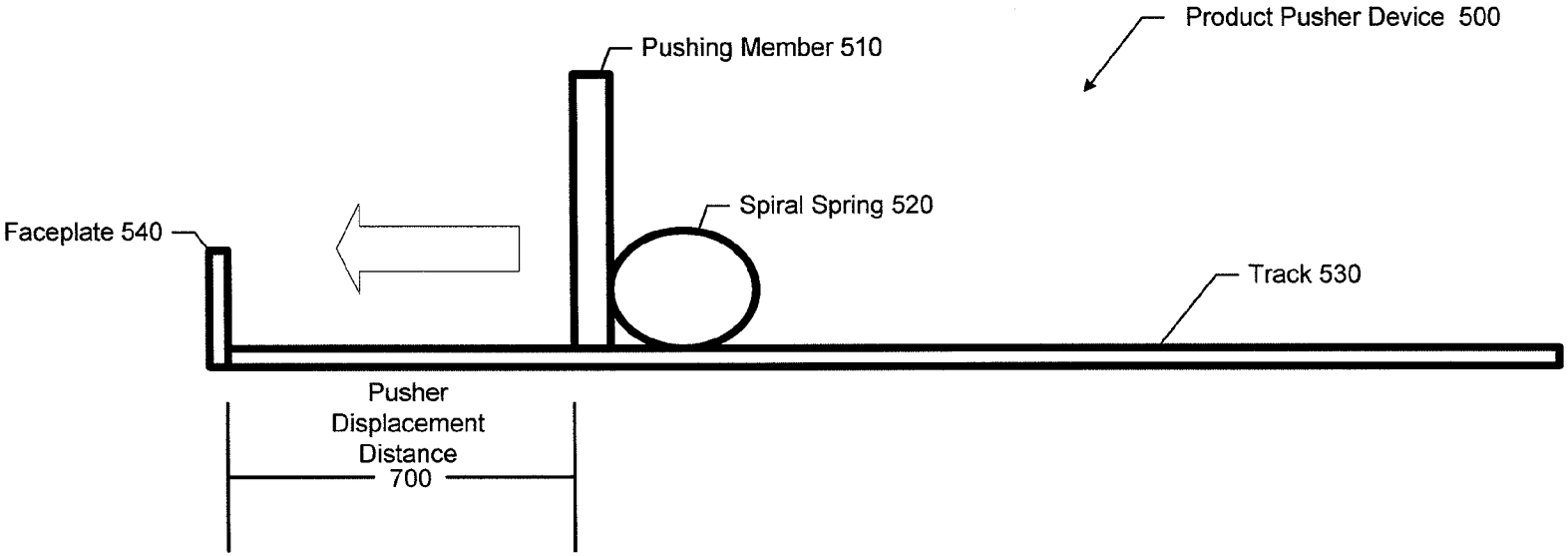
FIG. 1 is an illustration of an example product pusher device according to some example embodiments of the present invention.

Some embodiments of the present invention will now be described more fully hereinafter with reference to the accompanying drawings, in which some, but not all embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout.

As defined herein a "computer-readable medium" may encompass both transitory and non-transitory media. However, a "computer-readable storage medium" refers to a non-transitory medium, such as for example, a memory device, while a "computer-readable transmission medium" refers to transitory medium, such as, for example, propagating electromagnetic signals. Additionally, as used herein, the term "circuitry" refers to not only hardware-only circuit implementations including analog and/or digital circuitry, but at least also to combinations of hardware with corresponding software and/or instructions stored on a computer-readable storage medium.

Various example embodiments of the present invention may operate, and/or may be configured, to detect and respond to theft and sales activity associated with the use of a product pusher device. FIG. 1 illustrates an example product pusher device 500 that may be used in combination with various example embodiments. While the product pusher device 500 illustrates one type of product pusher device, one of skill in the art would appreciate that the various example embodiments of the present invention may be used in combination with a variety of product pusher devices.

The product pusher device 500 may be installed on a shelf of a retail store to display product that is stocked in the product pusher device 500. Retail stores utilize product pushers for a variety of reasons, however, one common reason that retail stores utilize product pushers is due to their "self-facing" capability. A product pusher operates to continually push product to the edge of the shelf, thereby providing maximum accessibility to the product, even as the quantity of products on the shelf is reduced. Also, by continually moving product to the edge of the shelf, visibility of the product is also maintained as the product quantity on the shelf is depleted. As a result of this product visibility aspect, product pushers tend to create an organized and clean display of products on a shelving unit that is attractive to customers.

To perform these and other functions the product pusher device 500 may include a pushing member 510, a force exertion device (e.g., a spiral spring 520), a track 530, and a faceplate 540. Some trackless product pushers may also be utilized. As depicted in FIG. 1, the force exertion device, in this case the spiral spring 520, exerts a force on the pushing member 510 in the direction of the faceplate 540. It is contemplated that this force may be generated in a number of ways through the additional or alternative use of coil springs that either push or pull the pusher member towards the faceplate 540. Further, in some example embodiments, the pusher member 510 may move along a declined plane towards the faceplate 540, and therefore gravity may generate or contribute to the force generated towards the faceplate 540. In this instance, the force exertion device may simply be the weight of the pusher member 510. The force that is applied to the pushing member 510 would also be applied to a product that is placed in between the pushing member 510 and the faceplate 540. Therefore, the force, assuming a sufficient magnitude, would tend to push the product towards the faceplate 540 until the rests against the faceplate 540, or another stopping member (not depicted). The track 530 may be configured to maintain the orientation of the pushing member 510 with the faceplate 540.

When products are stocked into the product pusher device 500, the pushing member 510 is displaced from a resting position (either dictated by the faceplate or a stop) that the pushing member would be in if no product was stocked into the product pusher device 500. The displacement of the pushing member from its out-of-stock resting position may be referred to as the pusher displacement distance 700. As will be described in further detail with respect to FIG. 2B, this pusher displacement distance 700 may be measured and used to perform functionalities such as pusher stock inventory counting.

Figure 2A:
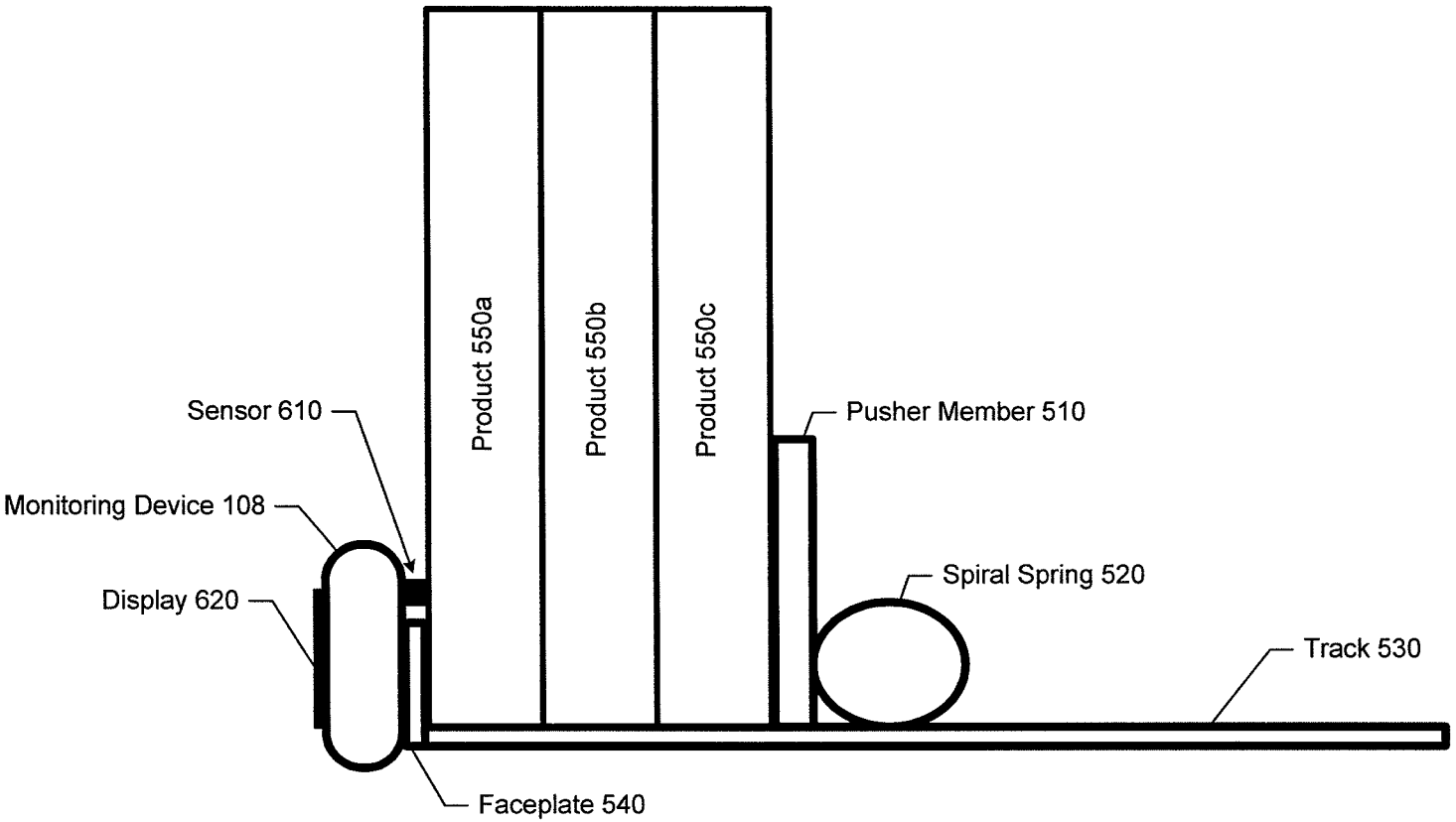
FIG. 2A is an illustration of an example product pusher device and a forward-mounted pusher monitoring device according to some example method embodiments of the present invention.

FIG. 2A illustrates an example embodiment of the present invention in the form of a monitoring device 108 that may be combined with the product pusher device 500 at or near the faceplate end of the product pusher device 500. As depicted in FIG. 2A, the product pusher device 500 is stocked with products 550*a*, 550*b*, and 550*c*, which have been moved to the front of the product pusher device 500 by the force applied on the products by the pusher member.

The monitoring device 108 may be configured to detect theft or sales activity, and wirelessly report that activity to a server, thereby enabling a variety of responsive actions that may be undertaken by the monitoring device 108 and/or the server. As described herein, the physical interaction between a product in the product pusher device 500 and an individual (e.g., customer, store personnel, etc.) may be referred to as product movement activity. As such, product movement activity may occur when store customers or store personnel remove one or more products from the product pusher device 500 or insert one or more products into the product pusher device. According to some example embodiments, product movement activity need not require complete removal or insertion of a product, but merely the jostling of the product may be sufficient to constitute product movement activity.

To support the detection of product movement activity and other functionalities, the monitoring device 108 may include a sensor 610 that detects the movement of the pusher member 510, possibly via the movement of products that are in physical contact with the pusher member 510. In some example embodiments, such as the example embodiment illustrated in FIG. 2A, the sensor may be a contact switch and may be disposed in a position such that, when the product pusher device 500 is stocked with at least one product, the contact switch is depressed, and when a product is not stocked (i.e., the product pusher device 500 is empty) the contact switch is not depressed. As such, the output provided by the contact switch may be binary. Further, the contact switch may be sufficiently sensitive to detect the movement of a product in the product pusher device 500. For example, as a customer removes a product from the product pusher device 500, the switch may not be depressed for a short period of time before the force exerted by the pusher member 510 moves the next product into contact with the contact switch.

A processor of the monitoring device may be polling the state of the contact switch to receive signals indicating of product movement activity. The changes in the state of the switch may be detected by the processor, and the processor may be configured to analyze the signals received via the contact switch to determine a product movement activity type for the signals received via the contact switch. To determine a product movement type, the characteristics of the signals, including the timing of the signals, received via the contact switch may be analyzed with respect to movement activity templates to determine a product movement activity type for a given movement event.

For example, one movement activity template may be defined for determining an out-of-stock condition and an associated product movement activity type. The out-of-stock product movement activity template may include logic for determining if the contact switch has not been depressed for a threshold period of time (e.g., one minute). If upon application of the template to the signals received from the contact switch, the processor determines that the result is "true" then the product movement activity type indicating that the removal of a last product in the product pusher device has occurred.

Another example movement activity template may be defined for the removal or insertion of a product in the product pusher device. In this regard, the movement activity template may include logic for determining if the contact switch had experienced a depressed-not depressed-depressed sequence over a given period of time. If the application of this movement activity template on the signals received from the contact switch returns a "true", then a product removal or insertion has occurred and an associated product movement activity type has been determined.

As such, the monitoring device 108 may be configured to determine a movement activity type based on the signal characteristics (e.g., state and timing) provided by the sensor 610. The processor may be configured to repeatedly check a number of movement activity templates to determine whether a product movement activity type has been identified. Accordingly, the processor may be configured to determine any number of product movement activity types including (1) a removal of a product activity type, (2) an insertion of a product activity type, (3) a last product removed/out-of-stock activity type, and the like.

Upon determining a product movement activity type as described above, the processor of the monitoring device 108 may be configured to generate a pusher activity message that includes a representation of the product movement activity type for wireless transmission to a server. As such, the monitoring device 108 may include a radio frequency-based communications interface for transmitting the pusher activity message. In some example embodiments, the monitoring device 108 may transmit the pusher activity message to a server, which, in turn, may notify an individual of the activity by, for example, sending an internet-based message (e.g., an email, instant message, tweet, status update) or send a text message, either of which may be received on a computer or handheld device to alert the individual of the activity. In this regard, if activity is detected with respect to the movement of a high priced product, store personnel may be notified of the activity to alert of a possible theft or to ask a customer if assistance is required.

According to some example embodiments, the monitoring device 108 may also include a display 620. The display may be an LCD display, an e-ink display, or the like. The Display may be in communication with the processor of the monitoring device 108 to present information, for example, to a customer. In this regard, the display may present the sales price for the products stocked in product pusher device 500. The monitoring device 108 may be configured to receive, via the wireless communications interface of the monitoring device 108, a sales price. The processor of the monitoring device 108 may be configured to provide the sales price information to the display 620 for presentation.

Figure 2B:
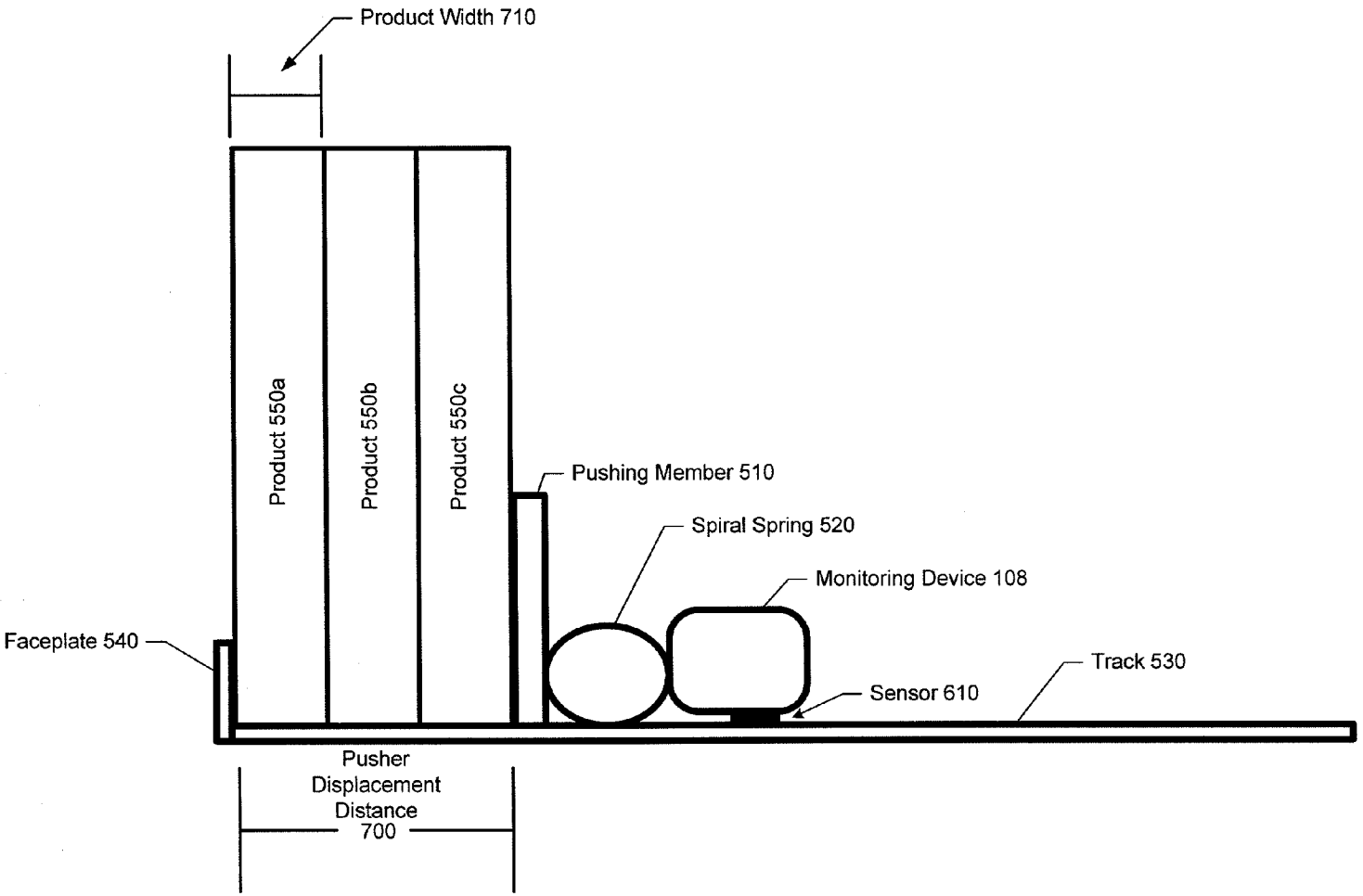
FIG. 2B is an illustration of an example product pusher device and a pusher member-mounted pusher monitoring device according to some example method embodiments of the present invention.

Now referring to FIG. 2B, another example embodiment of the monitoring device 108 is provided. Here, the monitoring device 108 is additionally, or alternatively configured to track the movement (e.g., distance of movement) of the pusher member 510. To do so, in some example embodiments, the monitoring device 108 may be affixed to, or integrated with, the moving portion of the product pusher device 500 (e.g., the pushing member 510). Via the ability to measure distances traveled by the pushing member 510, the monitoring device 108 may be configured to track the inventory of products in the product pusher device 500 and identify potential theft scenarios.

In this regard, the sensor 610 may be positioned and configured to detect a distance and direction that the pusher member 510 has moved. This information may be included in the sensor signals that are provided to the processor of the monitoring device 108. The processor may then analyze the sensor signals to determine, based on a respective movement activity template, whether a product has been removed or inserted, and how many products have been removed or inserted. To make these determinations, the monitoring device 108 may first need to be calibrated for the size of products that are being stocked in the product pusher device 500.

To calibrate the monitoring device 108 for the size of products, the monitoring device 108 may first determine the current pusher displacement distance 700. The current pusher displacement distance 700 may be determined relative to the rest position that the pusher member 510 assumes when no products are stocked in the product pusher device 500. This rest position may be set by, for example, using a calibration user interface (e.g., engaging a calibration button) on the monitoring device 108. Having set and stored the rest position, the monitoring device can now use the stored rest position as a reference for determining the current pusher displacement offset. While this provides one example methodology for setting a reference position, it is contemplated that other reference positions may be alternatively utilized such as, for example, the maximum displacement of the pushing member 510.

Another operation that may be part of the calibration process is determining the width 710 of a product that is to be stocked in the product pusher device 500. It is assumed, according to some example embodiments, that the same sized products are stocked in the product pusher device 500. As such, a user may, for example, insert a single product into the product pusher device 500, and use the calibration user interface (e.g., engaging a calibration button) again to set the width of a single product. Alternatively, since the monitoring device 108 is able to measure the current pusher displacement distance relative to the rest position, the pusher may be stocked with more than one product and the user may use the calibration user interface to provide the monitoring device 108 with a count of the number of products currently stocked in the product pusher device 500. The monitoring device 108 may then be configured to divide the current pusher displacement distance by the number of products to determine the product width 710. In some example embodiments, when the monitoring device 108 is commissioned for use with a particular product, the server may wirelessly communicate the width of the product to the monitoring device.

It is contemplated that, based on the type of sensor being used, the product width may be represented and utilized in a variety of ways. For example, if the sensor 610 uses a potentiometer of a mechanical encoder to determine distances, then the product width may be represented by a given resistance value. Other types of sensors may measure distances based on other standards. For example, in some example embodiments, the sensor 610 may be an optoelectronic sensor (similar to the sensor used in an optical computer mouse), which uses digital images and image processing hardware to track distances. Other example embodiments, may utilize various type of digital encoders and optical rotary encoders that may measure distance as a number of tracks that have passed a photo-detector during the movement.

Since the mis-calibration or improper calibration may cause the monitoring device 108 to be susceptible to poor operation or increase the risk of undetected product theft, a security feature may be implemented by the monitoring device 108 to limit the ability to recalibrate the monitoring device 108. In some example embodiments, the monitoring device 108 may not enter a calibration mode unless the monitoring device 108 first receives a calibration message from the wireless network and/or the server described below. Alternatively, the monitoring device 108 may be configured to not enter a calibration mode unless a magnetically actuated switch is in a desired state. The processor of the monitoring device 108 may monitor the state of the magnetically actuated switch. To actuate the switch, a specialized, magnetic key may be required that interfaces with the monitoring device 108 to actuate the switch. According to some example embodiments the magnetic key may also be required to gain access to a battery compartment, and for mounting and detaching the monitoring device 108 from the product pusher device 500. In some example embodiments, for mounting purposes, a plurality of interchangeable clips and holders for attaching the monitoring device 108 to the product pusher device 500 may be utilized.

Regardless of the type of sensor and the manner in which the calibration is performed, the monitoring device 108, and its processor, may be configured to determine a product movement activity type based on the application of a product movement activity template and the representations of movement distances and directions indicated in the signals received from the sensor. In this regard, based on an associated template, if the pusher member 510 moves the distance of the product width in the direction of the faceplate 540, then a product removal activity type is determined. If the pusher member 510 moves the distance of the product width in the direction away from the faceplate 540, then a product insertion activity type is determined.

Additionally, a product movement activity template may be defined with respect to a theft sweep event. In this regard, if more than a threshold number of products are removed from the product pusher device 500 within a threshold amount of time a theft may be occurring and store personnel may be notified. To implement this functionality, a product movement activity template may define the threshold number of products and the threshold amount of time. If the signals provided by the sensor indicates that the product movement activity template is "true", then a theft sweep event activity type may be determined, and a pusher activity message, as indicated above, may be transmitted to the server for subsequent action (e.g., sending notifications).

Further, in response to, for example, a theft event such as a sweep, alarming functionality may be implemented. In this regard, the monitoring device 108 may include a local audible alarm that can be triggered and sounded if a particular product movement activity type is determined (e.g., a sweep). Also, the server that receives the pusher activity message may trigger and sound an alarm, such as, a store-wide alarm.

Further, the server that receives the pusher activity message may be configured to implement a variety of functions in response to receipt of a pusher activity message. Based on the product movement activity type, the server may increment or decrement the number of products that are currently in inventory, in the aggregate or with respect to a singular product pusher device 500.

According to some example embodiments, the monitoring device 108, being a wireless device, may be configured to execute a battery saving sleep mode. In this regard, the monitoring device may power down at least the wireless communications interface after a threshold duration of time since the sensor last detected movement. Further, the monitoring device 108 may maintain this state, with at least the wireless communications interface in the powered down sleep mode until the sensor detects movement.

According to some example embodiments, rather than the monitoring device 108, a server may determine the product movement activity type based on sensor information provided to the server by the monitoring device. As such, the monitoring device 108 may relay movement and direction information derived from the sensor signal to the server to permit the server to determine the product movement activity type. The product movement activity type, therefore, according to some example embodiments, need not be determined at the monitoring device 108, and the information needed to determine the product movement activity type (e.g., sensor signal information) may be forwarded to the server for analysis at the server.

Figure 3:
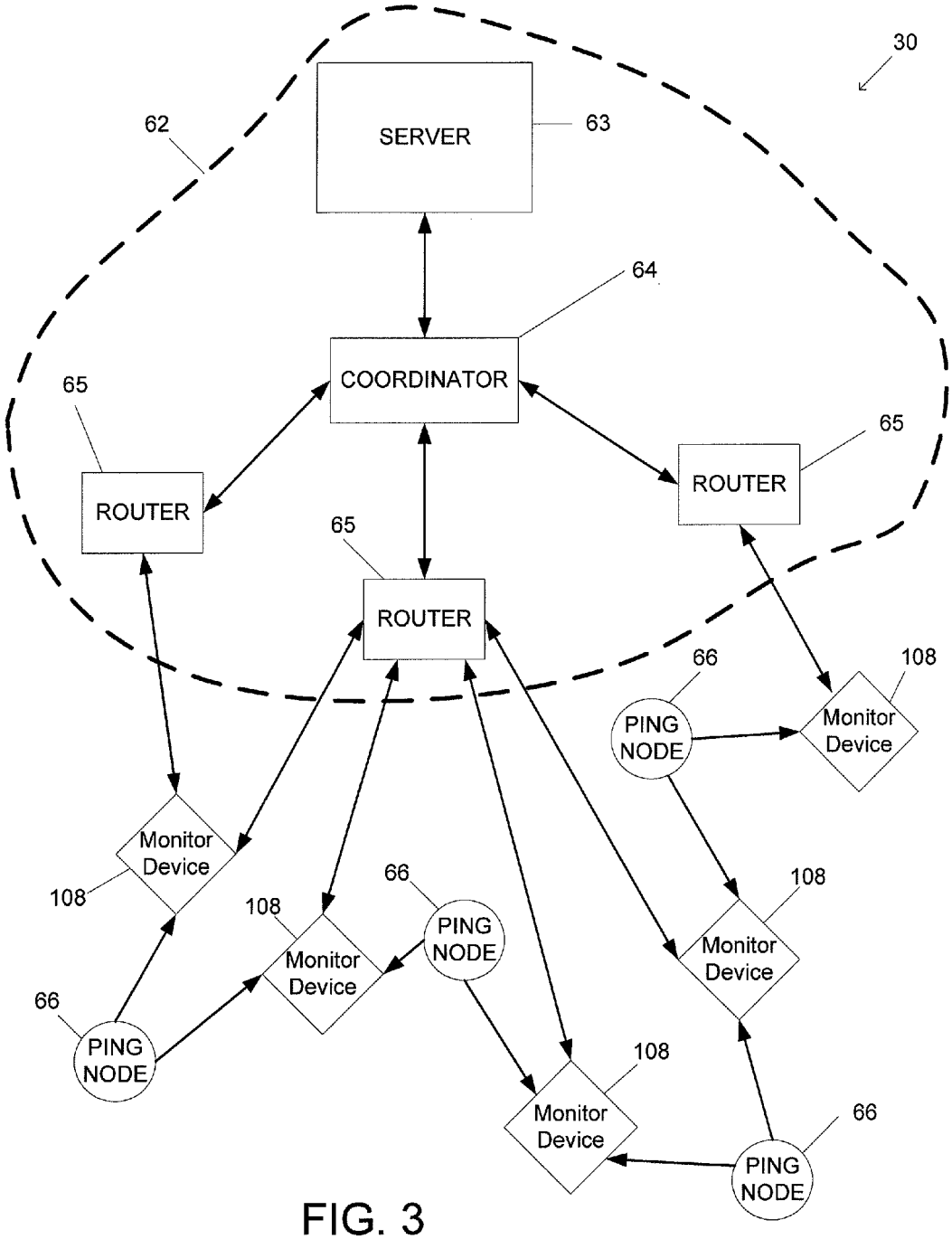
FIG. 3 is a schematic block diagram of a network according to an example embodiment of the present invention.
Figure 4:
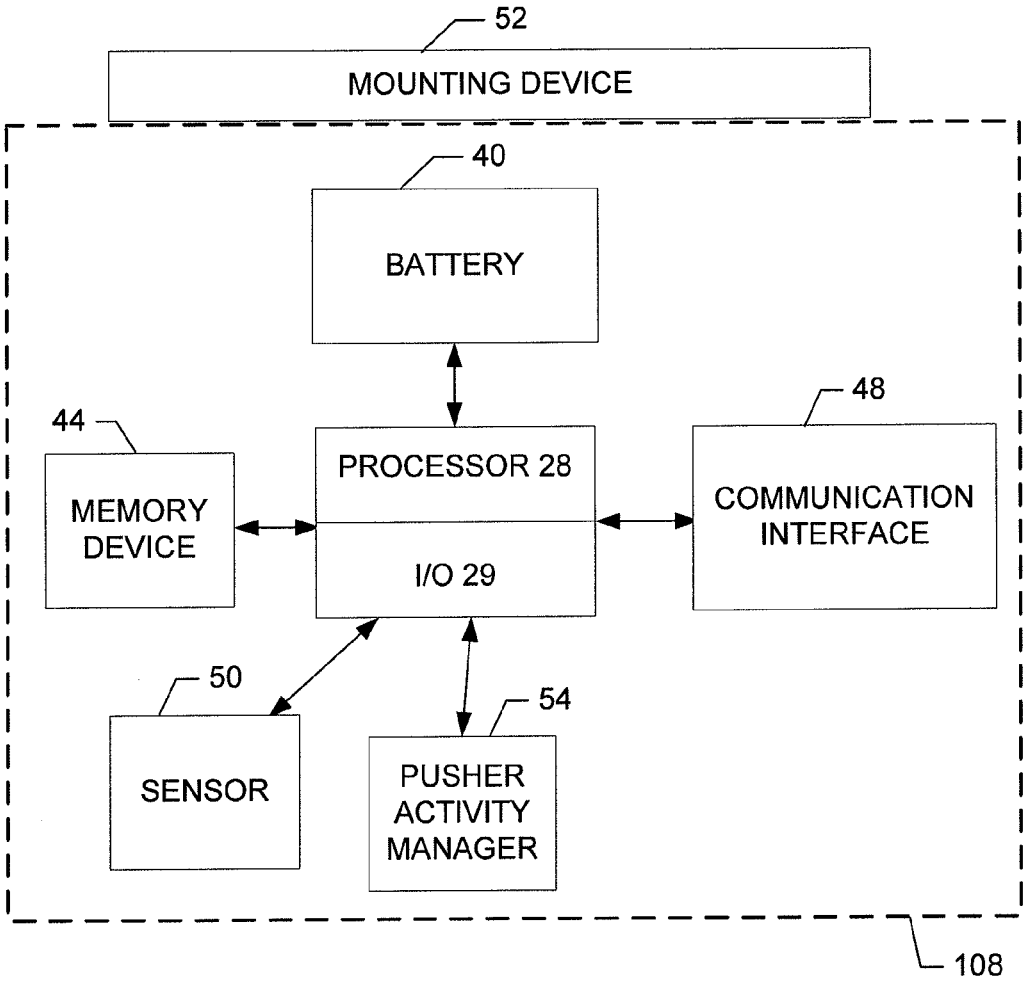
FIG. 4 illustrates an example monitoring device that is specifically configured for performing functionality according to an example embodiment.
Figure 5:
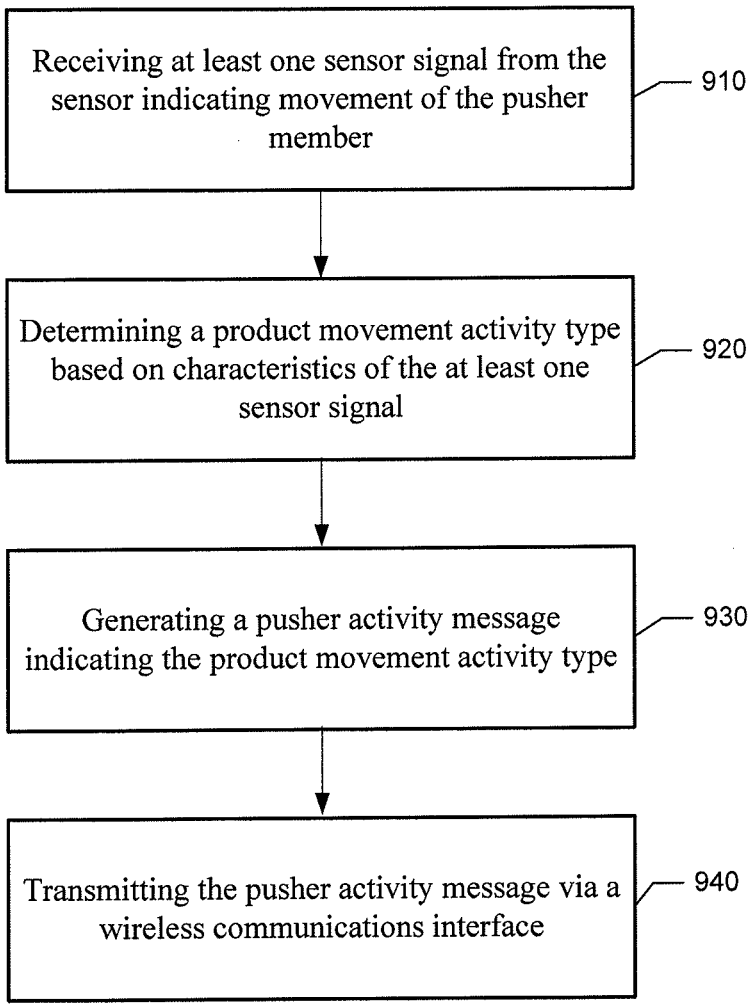
FIG. 5 is a flowchart of an example method for activity of product pusher device according to various example embodiments.

FIGS. 3-5 provide detailed descriptions of some example architectures of systems and devices that are configured to perform the functionality described with respect to FIGS. 1, 2A, 2B, and otherwise herein. One of skill in the art would appreciate that the descriptions of FIGS. 3-5 are directed to example architectures and configurations and that equivalent alternative structures configured to perform the same functionality are also contemplated.

FIG. 3 illustrates an example embodiment of a network 30, which may comprise a network entity 62 and at least one monitoring device 108. The network entity 62 may comprise a server 63 and a coordinator 64. In some example embodiments, the network entity may include at least one router 65. The coordinator 64 may be configured to perform the role of the coordinator 64 as described herein and may also be configured to perform the role of router. The server 63 may be configured to manage, control, and/or log the operation of the entities connected to the network 30. The server's connection to the network 30 may be provided via the coordinator 64. The coordinator 64 may be configured to route communications to and from the server 63 and amongst the routers 65, as needed. In the depicted example embodiment, multiple routers 65 communicate with the coordinator 64. The routers 65 may be configured to receive signals from the monitoring devices 108 and communicate that signal, or a modified version of that signal, to the coordinator 64 and the server 63. The routers 65 and coordinator 64 may include radio transmitters/receivers for sending and receiving wireless signals and may embody the communications infrastructure of the network 30. The communications connections amongst the routers 65 and between the coordinator 64 may be wired or wireless connections. Additionally, in some example embodiments, the coordinator 64 may be connected to the server 63 via a wired connection, which may support higher speeds and bandwidth relative to other wireless communications connections within the network 30.

The ping nodes 66 (also referred to as locators) may be placed throughout an environment, such as a commercial or retail environment, at designated positions to track the presence of monitoring devices 108 within areas associated with the positions of the ping nodes 66. The ping nodes 66 may be configured to transmit ping signals. As such, based on the foregoing description of the gate node 104, the gate node 104 may include ping node functionality. As mobile devices, the monitoring devices 108 may move throughout the environment and receive the ping signals transmitted from the ping nodes 66. When active and commissioned, the monitoring devices 108 may be configured to wirelessly transmit status signals indicating which ping nodes and gate nodes the monitoring devices 108 are currently receiving ping signals to thereby report the identities of the ping nodes to the server 63 via the routers 65 and coordinator 64.

According to some example embodiments, the network entity 62 comprises a server 63. The server 63 may comprise a processor, a communication interface, and a memory device. The server may be configured to perform functionality as described herein and may perform operations associated with management of the network 30.

As mentioned above, and referring again to FIG. 3, the ping nodes 66 may be placed throughout a commercial environment and can be leveraged to determine a location of a monitoring device 108. The ping nodes 66 may be configured to transmit ping signals, which may include ping node location data. The ping node location data may include a unique identifier of the ping node, such as a number or other unique indicator that corresponds to that specific ping node 66. In other embodiments, the ping node location data could include local coordinates or other similar data that may be used by the network to identify the location of a transmitting ping node. Ping nodes 66 may comprise antennas and radio transmitters for sending signals. In some embodiments, ping nodes 66 may have a tailored or specifically configured transmission signal strength so as to define the area which their ping signal can be received by the monitoring devices 108. Accordingly, the ping nodes 66 may be useful in locating monitoring devices 108 and other similar area-based features of the network 30.

Descriptions of example embodiments of ping nodes, and associated network systems, are provided in U.S. Provisional Patent Application No. 61/246,393, filed Sep. 28, 2009, entitled "Systems, Methods and Apparatuses for Managing Configurable Monitoring Devices;" U.S. Provisional Patent Application No. 61/248,196, filed Oct. 2, 2009, entitled "Systems, Methods and Apparatuses for Locating Configurable Monitoring Devices;" U.S. Non-Provisional patent application Ser. No. 12/636,564, filed Dec. 11, 2009, entitled "Systems, Methods, and Apparatuses for Managing Configurable Monitoring Devices;" and U.S. Non-Provisional patent application Ser. No. 12/887,228, filed Sep. 21, 2010, entitled "Retail Product Tracking System, Method, and Apparatus;" the contents of which are all hereby incorporated by reference in their entirety.

Ping nodes 66 may be involved in the frequent transmission of communications and therefore power utilization of a ping node 66 may be relatively high. While ping nodes 66 may be battery powered, in some example embodiments, ping nodes 66 may be powered through a building's wired power system. In this regard, routers 65 may also be configured to perform the function of a ping node 66. In some embodiments, ping nodes may utilize a battery.

FIG. 4 illustrates an example configuration of a monitoring device 108. A monitoring device 108 may be removably attached to, permanently attached to, or integrated into, for example, a product pusher device. The monitoring device 108 may be configured to monitor the sales and theft activity associated with a product pusher device as described with respect to FIGS. 2A and 2B. The monitoring device 108 may be configured to receive ping signals and a corresponding ping node identifier from a nearby ping node 66. The monitoring device 108 may also be configured to transmit a status signal identifying the ping node and including the pusher activity message to, for example, the server 63. The server 63 may then take action with respect to the received status signal as described herein. Further examples of monitoring devices and monitoring device functionalities are described in U.S. Non-Provisional patent application Ser. No. 12/628,863, filed Dec. 1, 2009, entitled "Configurable Monitoring Device;" and U.S. Non-Provisional patent application Ser. No. 12/887,228, filed Sep. 21, 2010, entitled "Retail Product Tracking System, Method, and Apparatus;" the contents of which are both hereby incorporated by reference in their entirety.

The monitoring device 108 may comprise a processor 28, a radio transmitter/receiver 46, a battery 40 (e.g., to power the components of the monitoring device 108), a sensor 50, and pusher activity manager 54. In some example embodiments, the monitoring device may also include a display, an alarm, lighting elements (e.g., LEDs), and/or a user input interface. In some embodiments, the monitoring device 108 may include a memory device 44 and/or an input/output device 29. Further, in some embodiments, the monitoring device 108 may include a mounting device 52 for attaching the monitoring device 108 to a product pusher device.

In an example embodiment, the processor 28 may be configured (e.g., via execution of stored instructions or operation in accordance with programmed instructions) to control the operation of the monitoring device 108. The processor 28 may be embodied in a number of different ways. For example, the processor 28 may be embodied as a hardware device including one or more of various hardware processing means or devices such as a coprocessor, a microprocessor, a controller, a digital signal processor (DSP), a processing element with or without an accompanying DSP, or various other processing devices including integrated circuits such as, for example, an ASIC (application specific integrated circuit), an FPGA (field programmable gate array), a microcontroller unit (MCU), a hardware accelerator, a special-purpose computer chip, or the like. In an example embodiment, the processor 28 may be configured to execute instructions stored in a memory device (e.g., memory device 44 of FIG. 4) or otherwise accessible to the processor 28. The instructions may be permanent or non-volatile (e.g., firmware) or modifiable (e.g., software) instructions. Alternatively or additionally, the processor 28 may be hardware configured to execute functionality, for example when embodied as an ASIC. As such, whether configured by hardware or software methods, or by a combination thereof, the processor 28 may represent an entity and means (e.g., physically embodied in circuitry) capable of performing operations according to embodiments of the present invention while configured accordingly. Thus, for example, when the processor 28 is embodied as an ASIC, FPGA or the like, the processor 28 may be specifically configured hardware for conducting the operations described herein. Alternatively, as another example, when the processor 28 is embodied as a hardware executor of software or firmware instructions, the instructions may specifically configure the processor 28 to perform the algorithms and/or operations described herein when the instructions are executed. The processor 28 may include, among other things, a clock, an arithmetic logic unit (ALU) and logic gates configured to support operation of the processor 28.

The processor 28 may also include an input/output (I/O) 29, which may include ports (or pins). According to some example embodiments, the I/O 29 may be configured to interface with any number of external devices such as, electronic security devices, tamper detection components, merchandising displays, audio signal emitting devices (including alarms, speakers, piezo buzzers, etc,), microphones, lights (e.g., light emitting diodes (LEDs) including dual-color LEDs), buttons, keypads, monitors, displays that present human-readable information (e.g., for changeable pricing labels), sensors (e.g., accelerometers, movement sensors (e.g., jiggle switch), light sensors, temperature sensors), cameras, camera controls (e.g., configured to forward still pictures), store audio systems, customer counters, lighting switches, barcode scanners, RFID readers, loyalty card scanners, communications hardware (e.g., USB hardware, Ethernet hardware, RS232 hardware), and the like. As such, the I/O 29 may be configured to support various functionality that the monitoring device may be configured to perform. As another example, an I\O pin or port may interface with an LED to cause the LED to flash at a regular interval to provide a visual indication of the status of the monitoring device and operate to attract the attention of store personnel or customers. For yet another example, an I\O pin or port may be configured to interface with a piezo buzzer or other audio device to emit various audible tones by the processor 28. According to various example embodiments, actuation of the switch sensor and detection of the actuation by the I/O may be a trigger event, which may have a corresponding event indication signal, for the monitoring device to transition a commissioned monitoring device from a sleep state (e.g., which may be a low power mode) to an active awake state (e.g., to provide wireless signals).

The memory device 44 may include, for example, one or more volatile and/or non-volatile memories. In other words, for example, the memory device 44 may be a non-transitory electronic storage device (e.g., a computer-readable storage medium) comprising gates (e.g., logic gates) configured to store data (e.g., bits) that may be retrievable by a machine (e.g., a computing device including a processor such as processor 20). The memory device 44 may be configured to store information, data, applications, instructions or the like for enabling the server 63 to carry out various functions in accordance with example embodiments. For example, the memory device 44 may be configured to buffer input data for processing by the processor 20. Additionally or alternatively, the memory device 44 may be configured to store instructions for execution by the processor 28.

In this regard, instructions stored on the memory device 44 may be specifically tailored to direct the operation of the monitoring device 108 via the processor 28. As indicated above with respect to the processor 28, the monitoring device 108 may be battery operated and thus a low power consuming memory device 44 may be more desirable. The memory device 44 may be an electronic storage device (e.g., a computer-readable storage medium) comprising gates configured to store data (e.g., bits) that may be retrievable by a machine (e.g., a computing device including a processor such as processor 28). The memory device 44 may be configured to store information, data, applications, instructions or the like, which can be organized in any manner (including as various types of functionality profiles), that enable the monitoring device 108 to carry out various functions in accordance with exemplary embodiments of the present invention. For example, the memory device 44 may be configured to buffer input data for processing by the processor 28. Additionally or alternatively, the memory device 44 may be configured to store instructions for execution by the processor 28.

The communications interface 48 may be any means such as a device or circuitry embodied in either hardware, or a combination of hardware and software that is configured to receive and/or transmit data from/to a network and/or any other device or module in wire or wireless communication with monitoring device 108. Communications interface 48 may include, for example, an antenna (or multiple antennas) and supporting hardware and/or software for enabling communications with network 30 or other devices. Additionally, to support network communications, the communications interface 48 may support the implementation of a system-wide synchronized clock. Synchronization of the clock may be maintained via a clock signal. Monitoring devices may include real time clock circuitry to support the synchronized clock and to regulate the use of precise communications windows. Additionally or alternatively, the communications interface 48 may include an unsynchronized clock.

In an example embodiment, the communications interface 48 may support communication via one or more different communication protocols or methods. In some embodiments, the communications interface 48 may be configured to support relatively low power, which may yield a relatively small communication proximity area. As such, for example, a low power and short range communication radio (e.g., radio transmitter/receiver) may be included in the communication interface 48. In some examples, a radio transmitter/receiver may include a transmitter and corresponding receiver configured to support radio frequency (RF) communication in accordance with an IEEE (Institute of Electrical and Electronics Engineers) communication standards such as IEEE 802.15 or IEEE 802.15.4a, which may yield a relatively larger communication proximity area. For example, some embodiments may employ Bluetooth, Wibree, ultra-wideband (UWB), WirelessHART, MiWi or other communication standards employing relatively short range wireless communication in a network such as a wireless personal area network (WPAN). In some cases, IEEE 802.15.4 or 4a based communication techniques, ZigBee, or other low power, short range communication protocols such as a proprietary technique based on IEEE 802.15.4 may be employed. According to some example embodiments, the communications interface 48 may be configured to support an Internet Protocol version 6 (IPV6) stack. The communications interface 48 may also support a Route Under MAC (Media Access Control) (RUM) protocol or a modified RUM protocol. Regardless of the protocol, the communications interface 48 may be configured to utilize a network identifier or network key, for example stored in the memory device 44, such as a personal area network (PAN) identifier. In some example embodiments, a monitoring device might not be permitted to communicate within the monitoring system without using a matching network identifier or key.

The sensor 50 may be any type of sensor capable of detecting movement of an object and generating signal outputs to the processor 28 for interpretation. In some example embodiments, the sensor 50 may be sub-system of the monitoring device 108 that includes multiple hardware components. In some example embodiments, as described above, the sensor may include a contact switch or push button that is positioned to rest up against a product that is stocked in a product pusher device. In some example embodiments, the sensor may include various means for detecting the movement of the pusher member and/or products in the product pusher device. In this regard, according to some example embodiments, the sensor may include a measuring wheel, an optical encoder, a mechanical encoder (which may include a potentiometer), an optoelectronic sensor and image processing hardware (similar to a sensor in an optical mouse), and/or the like.

In example embodiments where the monitoring device 108 includes an alarm, the alarm may be configured to produce an output, typically in the form of sound energy, although light, vibration or other outputs are also possible. As such, the alarm may include an output device such as one or more of a speaker, vibration pack, light (e.g., a light emitting diode (LED)), or other device. The processor 28 may be configured to control operation of the alarm based on, for example, instructions received from the server 63 or in response to defined indications from the sensor 50. In this regard, based on the current configuration of the monitoring device 108, an alarm condition may be identified and signaled to the alarm. In some embodiments, the alarm condition may be associated with a predetermined alarm signal, which the processor 28 may be configured to provide to the alarm to direct an output. The alarm may be configured to provide any number of different outputs in response to various alarm signals including but not limited to a tone or series of tones, a ringing noise, a recorded or synthetic voice output, a solid or flashing light with any of various predetermined flash sequences, a vibration that is either continuous or pulsed with various different pulse sequences, or various other outputs or combinations of the above and/or other outputs.

As indicated above, one or more monitoring devices 52 may be affixed to, or integrated into, a product pusher device. The mounting device 52, in some example embodiments may allow the monitoring device to be removable from the product pusher device. In some example embodiments, however, the monitoring device may be permanently affixed to a product pusher device.

The pusher activity manager 54, which may be embodied in hardware (e.g., when the processor 28 is, for example, an ASIC) or as hardware executing software (e.g., when for example, the processor 28 executes instructions stored on memory device 44), and may be configured to manage and direct the processor 28 to perform functions consistent with the various functionalities of the monitoring device 108 described herein and, in particular, the functionality described with respect to FIGS. 2A, 2B and 5. The processor 28 of an example embodiment may be embodied as, include or otherwise control, the pusher activity manager 54. The pusher activity manager 54 may be implemented by any means, such as a device or circuitry operating in accordance with firmware/software or otherwise embodied in hardware or a combination of hardware and firmware/software (e.g., processor 28 operating under software control, the processor 28 embodied as an ASIC or FPGA specifically configured to perform the operations described herein, or a combination thereof), thereby configuring the device or circuitry to perform the corresponding functions of the pusher activity manager 54, as described herein. Thus, in examples in which software is employed, a device or circuitry (e.g., the processor 28 in one example) executing the software algorithms described herein forms a structure associated with such means.

Further, the pusher activity manager 54 may be configured to cause the monitoring device 108 to perform the functionalities described with respect to the monitoring device 108 in FIG. 5. In this regard, the pusher activity manager 54 may be configured to receive at least one sensor signal, from the sensor, indicating movement of the pusher member at 910. The pusher activity manager 54 may be further configured to, at 920, determine a product movement activity type based on characteristics of the at least one sensor signal. In this regard, the product movement activity type may be selected from a group of product movement activity types that includes removal of a product from the product pusher device. The pusher activity manager 54 may also be configured to generate, at 930, a pusher activity message indicating the product movement activity type, and, at 940, cause the transmission of the pusher activity message via a wireless communications interface.

In some example embodiments, the pusher activity manager 54 may additionally or alternatively be configured to detect movement via the sensor, where the sensor comprises a contact switch. The contact switch may be positioned such that the contact switch is depressed in an instance in which a product is present in the product pusher device, and the contact switch is not depressed in an instance in which a product is not present in the product pusher device. Further, in some example embodiments, the pusher activity manager 54 may also be configured to determine that the product movement activity type is a removal of a last product in the product pusher device based on the characteristics of the at least one sensor signal indicating an absence of a product in the product pusher device. Additionally, or alternatively, the pusher activity manager 54 may be configured to detect, via the sensor, a distance and direction that the pusher member has moved based on a representation of the distance and direction in the at least one sensor signal. Further in this regard, the pusher activity manager 54 may be configured to determine that the product movement activity type is a removal of a product in the product pusher device or an insertion of a product into the shelf pusher based on the representation of the distance and direction that the pusher member has moved.

According to some example embodiments, the pusher activity manager 54 may be additionally or alternatively configured to detect movement via the sensor, where the sensor comprises an optoelectronic sensor and image processing hardware configured to detect movement. Further, according to some example embodiments, the pusher activity manager 54 may be configured to power down at least the wireless communications interface after a threshold duration of time since the sensor last detected movement, and maintain the wireless communications interface in the sleep mode until the sensor detects movement. In some example embodiments, the pusher activity manager 54 may be additionally or alternatively configured to receive, via the wireless communications interface, a sales price for products to be stocked in the product pusher device, and send a signal to a display affixed to the product pusher device to present the sales price on the display. Additionally or alternatively, according to some example embodiments, the pusher activity manager 54 may be configured to transmit the pusher activity message to a server to permit the server to send an internet-based or text message to a predefined recipient indicating a representation of the product movement activity type. In some example embodiments, the pusher activity message may be transmitted to the server to permit the server to sound an alarm. In some example embodiments, the pusher activity manager 54 may be additionally or alternatively configured to sound an audible alarm that is affixed to the product pusher device based on the product movement activity type. Additionally or alternatively, the pusher activity manager 54 may be configured to cause transmission of the pusher activity message to a server, to permit the server to increment or decrement an inventory count of products present in the product pusher device.

According to some example embodiments, the pusher activity manager 54 may additionally or alternatively configured to detect, via the sensor, a distance and direction that the pusher member has moved based on a representation of the distance and direction in the at least one sensor signal. Further in this regard, the pusher activity manager 54 may also be configured to determine that the product movement activity type is a theft sweep event involving the removal of at least a threshold number of products within a threshold duration of time based on the representation of the distance that the pusher member has moved over a period of time. Additionally or alternatively, according to some example embodiments, the pusher activity manager 54 may be configured to receive user input indicating a count of products present in the product pusher device, determine a current pusher deflection distance based on the one or more sensor signals, and calibrate a monitoring device for the size of a single product based on the current pusher deflection distance and the count of products. In some example embodiments, the pusher activity manager 54 may be additionally or alternatively configured to monitor a state of a magnetically actuated switch and enter a calibration mode based on the state of the magnetically actuated switch.

Example embodiments of the present invention may be implemented by various means, such as hardware, firmware, processor, circuitry and/or other device associated with execution of software including one or more computer program instructions. For example, one or more of the procedures or activities described above may be embodied by computer program instructions. In this regard, the computer program instructions which embody the procedures or activities described above may be stored by a memory device of an apparatus employing an embodiment of the present invention and executed by a processor in the apparatus. As will be appreciated, any such computer program instructions may be loaded onto a computer or other programmable apparatus (e.g., hardware) to produce a machine, such that the resulting computer or other programmable apparatus embody means for implementing the functions specified in the corresponding procedure or activity. These computer program instructions may also be stored in a computer-readable storage memory (as opposed to a computer-readable transmission medium such as a carrier wave or electromagnetic signal) that may direct a computer or other programmable apparatus to function in a particular manner, such that the instructions stored in the computer-readable memory produce an article of manufacture the execution of which implements the function specified in the corresponding procedure or activity. The computer program instructions may also be loaded onto a computer or other programmable apparatus to cause a series of operational steps to be performed on the computer or other programmable apparatus to produce a computer-implemented process such that the instructions which execute on the computer or other programmable apparatus provide steps for implementing the functions specified in the corresponding procedure or activity described above.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of this disclosure. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of this disclosure. In this regard, for example, different combinations of elements and/or functions than those explicitly described above are also contemplated as may be set forth in some of this disclosure. Although specific terms are employed herein, they are used in a generic and descriptive sense only and not for purposes of limitation.

What is claimed is:

1. A monitoring device for monitoring theft or sales activity associated with a product pusher device, the monitoring device comprising:

a sensor configured to detect movement of a pusher member of the product pusher device;

a wireless communications interface;

a processor configured to:

receive at least one sensor signal from the sensor indicating movement of the pusher member, determine a product movement activity type based on characteristics of the at least one sensor signal, the product movement activity type being selected from a group of product movement activity types that includes removal of a product from the product pusher device, and generate, for transmission via the wireless communications interface, a pusher activity message indicating the product movement activity type; and a user input interface configured to receive, and provide to the processor, user input indicating a count of products present in the product pusher device;

wherein the processor is further configured to:

determine a current pusher deflection distance based on the at least one sensor signal; and calibrate the monitoring device for the size of a single product based on the current pusher deflection distance and the count of products;

wherein the user input interface includes a magnetically actuated switch; and wherein the processor is configured to monitor a state of the magnetically actuated switch and enter a calibration mode based on the state of the magnetically actuated switch.

2. The monitoring device of claim 1, wherein the sensor comprises a contact switch, and wherein the contact switch is positioned such that the contact switch is depressed in an instance in which a product is present in the product pusher device, and the contact switch is not depressed in an instance in which a product is not present in the product pusher device.

3. The monitoring device of claim 1, wherein the processor configured to determine the product movement activity type includes being configured to determine that the product movement activity type is a removal of a last product in the product pusher device based on the characteristics of the at least one sensor signal indicating an absence of a product in the product pusher device.

4. The monitoring device of claim 1, wherein the determination of the current pusher deflection distance includes determination of a direction that the pusher member has been deflected, wherein the sensor is further configured to include a representation of the deflection distance and direction in the at least one sensor signal; and wherein the processor configured to determine the product movement activity type includes being configured to determine that the product movement activity type is a removal of a product in the product pusher device or an insertion of a product into the shelf pusher based on the representation of the deflection distance and direction.

5. The monitoring device of claim 4, wherein the sensor comprises an optoelectronic sensor and image processing hardware configured to detect movement.

6. The monitoring device of claim 1, wherein the processor is further configured to:

power down at least the wireless communications interface after a threshold duration of time since the sensor last detected movement; and maintain the wireless communications interface in the sleep mode until the sensor detects movement.

7. The monitoring device of claim 1, further comprising a display; and wherein the processor is further configured to:

receive, via the wireless communications interface, a sales price for products to be stocked in the product pusher device; and send a signal to the display to present the sales price on the display.

8. The monitoring device of claim 1, wherein the wireless communications interface is configured to transmit the pusher activity message to a server configured to send an interne-based or text message to a predefined recipient indicating a representation of the product movement activity type.

9. The monitoring device of claim 1, wherein the wireless communications interface is configured to transmit the pusher activity message to a server configured to sound an alarm.

10. The monitoring device of claim 1, wherein the monitoring device comprises an audible alarm; and wherein the processor is further configured to sound the audible alarm based on the product movement activity type.

11. The monitoring device of claim 1, wherein the wireless communications interface is configured to transmit the pusher activity message to a server configured to increment or decrement an inventory count of products present in the product pusher device.

12. The monitoring device of claim 1, wherein the sensor is further configured to detect a representation of the deflection distance and a direction that the pusher member has been deflected, wherein the sensor is further configured to include a representation of the deflection distance and direction in the at least one sensor signal; and wherein the processor configured to determine the product movement activity type includes being configured to determine that the product movement activity type is a theft sweep event involving the removal of at least a threshold number of products within a threshold duration of time based on the representation of the deflection distance over a period of time.

13. A method for monitoring theft or sales activity associated with a product pusher device, the method comprising:

detecting, via a sensor, movement of a pusher member of the product pusher device;

receiving at least one sensor signal from the sensor indicating movement of the pusher member;

determining a product movement activity type based on characteristics of the at least one sensor signal, the product movement activity type being selected from a group of product movement activity types that includes removal of a product from the product pusher device;

generating a pusher activity message indicating the product movement activity type;

transmitting the pusher activity message via a wireless communications interface;

receiving ping signals, each ping signal comprising a unique identifier corresponding to an originating ping node;

receiving user indicating a count of products present in the product pusher device;

determining a current pusher deflection distance based on the at least one sensor signal;

calibrating a monitoring device for the size of a single product based on the current pusher deflection distance and the count of products; and monitoring a state of magnetically actuated switch and entering a calibration mode based on the state of the magnetically actuated switch.

14. The method of claim 13, wherein detecting movement includes detecting movement via the sensor, the sensor comprising a contact switch; and wherein the contact switch is positioned such that the contact switch is depressed in an instance in which a product is present in the product pusher device, and the contact switch is not depressed in an instance in which a product is not present in the product pusher device.

15. The method of claim 13, wherein determining the product movement activity type includes determining that the product movement activity type is a removal of a last product in the product pusher device based on the characteristics of the at least one sensor signal indicating an absence of a product in the product pusher device.

16. The method of claim 13, wherein determining the current pusher deflection distance includes determining a direction that the pusher member has been deflected, and a representation of the deflection distance and direction is included in the at least one sensor signal; and wherein determining the product movement activity type includes determining that the product movement activity type is a removal of a product in the product pusher device or an insertion of a product into the shelf pusher based on the representation of the deflection distance and direction.

17. The method of claim 16, wherein the sensor comprises an optoelectronic sensor and image processing hardware configured to detect movement.

18. The method of claim 13, further comprising:

powering down at least the wireless communications interface after a threshold duration of time since the sensor last detected movement; and maintaining the wireless communications interface in the sleep mode until the sensor detects movement.

19. The method of claim 13, further comprising:

receiving, via the wireless communications interface, a sales price for products to be stocked in the product pusher device; and sending a signal to a display affixed to the product pusher device to present the sales price on the display.

20. The method of claim 13, further comprising:

transmitting the pusher activity message to a server; and sending an internet-based or text message to a predefined recipient indicating a representation of the product movement activity type.

21. The method of claim 13, further comprising transmitting the pusher activity message to a server; and sounding an alarm.

22. The method of claim 13, further comprising sounding an audible alarm that is affixed to the product pusher device based on the product movement activity type.

23. The method of claim 13, further comprising transmitting the pusher activity message to a server; and incrementing or decrementing an inventory count of products present in the product pusher device.

24. The method of claim 13, wherein the determination of the current pusher deflection distance includes detecting a direction that the pusher member has been deflected, and a representation of the deflection distance and direction is included in the at least one sensor signal; and wherein determining the product movement activity type includes determining that the product movement activity type is a theft sweep event involving the removal of at least a threshold number of products within a threshold duration of time based on the representation of the deflection distance over a period of time.

25. A non-transitory computer readable medium having computer program code stored thereon, the computer program code configured to, when executed, cause an apparatus to perform:

receiving at least one sensor signal from a sensor indicating movement of a pusher member of a product pusher device;

determining a product movement activity type based on characteristics of the at least one sensor signal, the product movement activity type being selected from a group of product movement activity types that includes removal of a product from the product pusher device; and generating a pusher activity message indicating the product movement activity type for transmission via a wireless communications interface;

receiving ping signals, each ping signal comprising a unique identifier corresponding to an originating ping node;

receiving user input indicating a count of products present in the product pusher device;

determining a current pusher deflection distance based on the at least one sensor signal;

calibrating a monitoring device for the size of a single product based on the current pusher deflection distance and the count of products; and monitoring a state of a magnetically actuated switch and entering a calibration mode based on the state of the magnetically actuated switch.

26. The monitoring device of claim 1, wherein the processor is further configured to receive ping signals, each ping signal comprising a unique identifier corresponding to an originating ping node; and wherein the wireless communications interface is configured to transmit status signals, the status signals comprising the ping signal unique identifiers.

27. The monitoring device of claim 26, wherein the status signals are transmitted to a server, the server determining a location of the monitoring device based on the received status signals.

28. The method of claim 13, further comprising;

receiving ping signals, each ping signal comprising a unique identifier corresponding to an originating ping node; and transmitting status signals, the status signals comprising the ping signal unique identifiers.

29. The method of claim 28, wherein the status signals are transmitted to a server, the server determining a location of the monitoring device based on the received status signals.

* * * * *